United States Patent [19]

Waddell et al.

[11] 4,036,532

[45] July 19, 1977

[54] FLUIDIZING OUTLET

[75] Inventors: Jerry D. Waddell, O'Fallon; John J. Scheeter, St. Charles, both of Mo.

[73] Assignee: ACF Industries, Incorporated, New York, N.Y.

[21] Appl. No.: 727,030

[22] Filed: Sept. 27, 1976

Related U.S. Application Data

[63] Continuation-in-part of Ser. No. 616,508, Sept. 24, 1975, abandoned.

[51] Int. Cl.[2] ..... B65G 53/36

[52] U.S. Cl. ..... 302/53; 302/57

[58] Field of Search ..... 302/29, 31, 45, 47, 302/51-54, 57; 222/195; 259/DIG. 17; 214/83.28

[56] References Cited

U.S. PATENT DOCUMENTS

| | | | |
|---|---|---|---|
| 2,631,759 | 3/1953 | Hoopes | 302/29 |
| 3,020,093 | 2/1962 | Dorey | 302/52 |
| 3,099,494 | 7/1963 | Heinze | 302/31 |
| 3,264,037 | 8/1966 | Smith | 302/52 |
| 3,403,943 | 10/1968 | Stine et al. | 302/52 |
| 3,659,752 | 5/1972 | Carney et al. | 302/53 |
| 3,708,209 | 1/1973 | Dugge | 302/52 |

FOREIGN PATENT DOCUMENTS

| | | | |
|---|---|---|---|
| 714,298 | 10/1941 | Germany | 302/53 |

*Primary Examiner*—Evon C. Blunk
*Assistant Examiner*—Jeffrey V. Nase
*Attorney, Agent, or Firm*—Henry W. Cummings

[57] ABSTRACT

A fluidizing outlet is provided having plenum sheets which define with the sides of the bottom pan of the outlet a plenum chamber. At least a portion of the lower edges of the plenum sheets are spaced from the sides of the bottom pan a suitable distance to provide gaps which form first fluidizing openings. Openings are provided in the upper portion of the plenum sheets to provide second fluidizing openings to fluidize the lading. The respective sizes of the first and second fluidizing openings are of a size sufficient to fluidize the lading, and are sufficiently large that they are not readily clogged by contaminates; for example, from dirty supply air and/or improper outlet cleaning to prevent operation of the outlet, and of a size sufficient that substantially all of the lading is removed during unloading. It has been found that the spacing between the outlet pan and the plenum sheets forming the first fluidizing openings should be at least about 0.03 inches, and should not exceed about 0.04 inches. It has further been found that the openings in the plenum sheets forming the second fluidizing openings should have a cross-sectional area of at least about 0.002 in.$^2$, and should not exceed about 0.004 in.$^2$. The second fluidizing openings should be spaced from each other within the range 0.75 to about 1.25 inches.

16 Claims, 8 Drawing Figures

FLUIDIZING OUTLET

REFERENCE TO RELATED APPLICATION

This application is a continuation-in-part of application Ser. No. 616,508, filed Sept. 24, 1975, now abandoned.

BACKGROUND OF THE INVENTION

This invention relates to outlets for use in fluidizing and discharging of fluidizable ladings from containers, including but not limited to transportation type containers, overland trucks and railway hopper cars, by pneumatic or gravity discharge.

Fluidizing outlets have heretofore been provided which have permeable filter members or membranes through which air under pressure may be passed to fluidize the lading and discharge the same from a railway hopper car or other hopper type containers.

Such permeable members or membranes are relatively expensive and are subject to being contaminated by either a dirty air supply system which clogs the permeable member during fluidization from the side opposite the lading, or by an improper outlet cleaning procedure. Such an improper cleaning procedure may occur, for example, when lading left in the outlet after unloading is attempted to be removed with a water wash only, without turning on the supply air. If the supply air is not turned on, the remaining lading often clogs the permeable membrane and it must be replaced to obtain efficient unloading rates. With contaminated supply air the permeable member must be cleaned and/or replaced frequently during unloading to maintain efficient unloading rates and prevent damage to the permeable member.

In the above mentioned parent application, a fluidizing outlet is disclosed in which plenum sheets define with the sides of the bottom pan of the outlet a plenum chamber and in which at least a portion of the lower edges of the plenum sheets are spaced from the sides of the bottom pan a distance to provide gaps which form first fluidizing openings. Furthermore, openings are also provided in the upper portion of the plenum sheets to provide second fluidizing openings to fluidize the lading. In accordance with this parent application the respective sizes of the first and second fluidizing openings are sufficiently large that the are not readily clogged by contaminates from dirty supply air or from improper outlet cleaning, but the openings are of sufficient size to fluidize the lading.

German Pat. No. 714,298 discloses upper and lower openings in plates (*g*) for fluidizing air used to pneumatically convey particulate material from said container (*a*) through a vertical conduit (*b*) which passes through conduit (*a*). However no specific size or location of openings is disclosed in the German Patent.

Further testing of the outlet of the present invention carried out since the filing of the above identified parent application has generated data which establishes that in order to obtain effective fluidization of the lading, to avoid clogging of the openings and to obtain substantially complete cleanout of the lading during unloading, that the first and second said fluidizing openings must have certain locations and be within certain size ranges.

SUMMARY OF THE INVENTION

A fluidizing outlet is provided having plenum sheets which define with the sides of the bottom pan of the outlet a plenum chamber. At least a portion of the lower edges of the plenum sheets are spaced from the sides of the bottom pan a suitable distance to provide gaps which form first fluidizing openings. Openings are provided in the upper portion of the plenum sheets to provide second fluidizing openings to fluidize the lading. The respective sizes of the first and second fluidizing openings are of a size sufficient to fluidize the lading, and are sufficiently large that they are not readily clogged by contaminates; for example, from dirty supply air and/or improper outlet cleaning to prevent operation of the outlet, and of a size sufficient that substantially all of the lading is removed during unloading. It has been found that the spacing between the outlet pan and the plenum sheets forming the first fluidizing openings should be at least about 0.03 inches, and should not exceed about 0.04 inches. It has further been found that the openings in the plenum sheets forming the second fluidizing openings should have a cross-sectional area of at least about 0.002 in.$^2$, and should not exceed about 0.004 in.$^2$. The second fluidizing openings should be spaced from each other within the range 0.75 to about 1.25 inches. With these ranges it has been found that not more than about 1% of the lading remains in the hopper or container after the unloading operation is completed.

While non-rectangular outlets are within the scope of the present invention, rectangular outlets are preferred. For a rectangular outlet, end plenums and longitudinal plenums are preferably provided, and the length of the gap is preferably at least about 30% of the transverse distance between the inner edges of the longitudinal mounting flanges and at least about 50% of the distance between the inner edges of the transverse mounting flanges. The contour of the plenum sheets and bottom pan may be varied in defining the plenum chamber.

THE DRAWINGS

DESCRIPTION OF PREFERRED EMBODIMENTS

Figure 1:
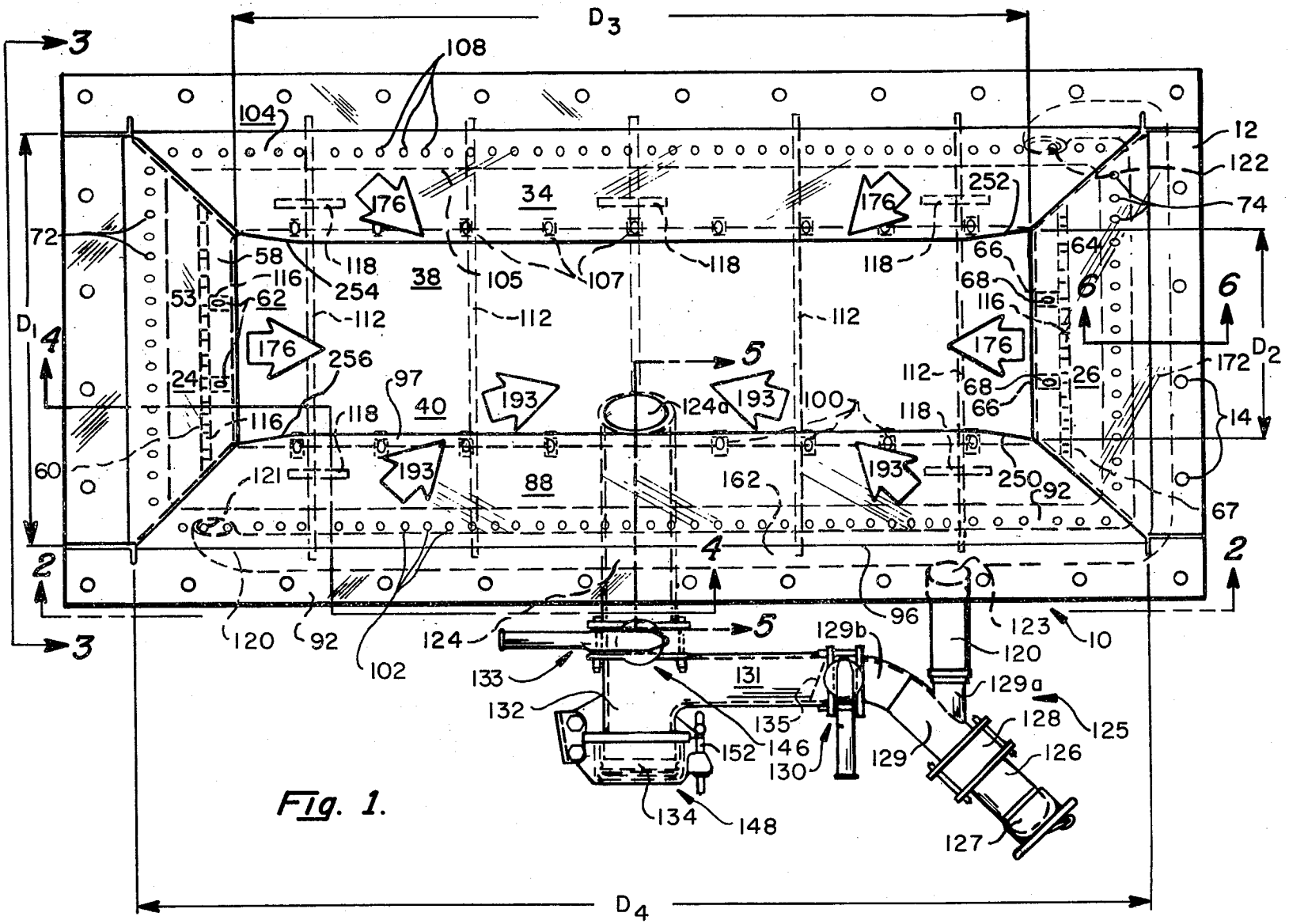
FIG. 1 is a plan view of one embodiment of an outlet in accordance with the present invention.
Figure 3:
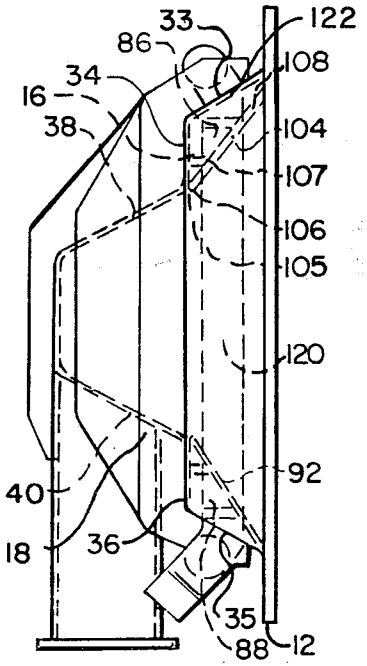
FIG. 3 is a side view of the outlet shown in FIG. 1 taken in the direction of the arrows along the line 3—3 in FIG. 1.
Figure 2:
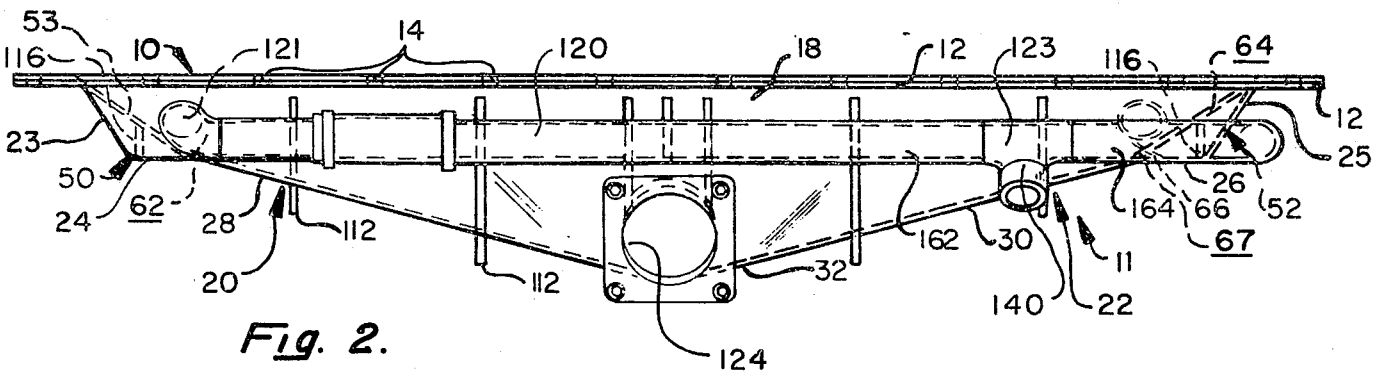
FIG. 2 is a front elevational view of the outlet shown in FIG. 1 taken in the direction of the arrows along the line 2—2 in FIG. 1.
Figure 4:
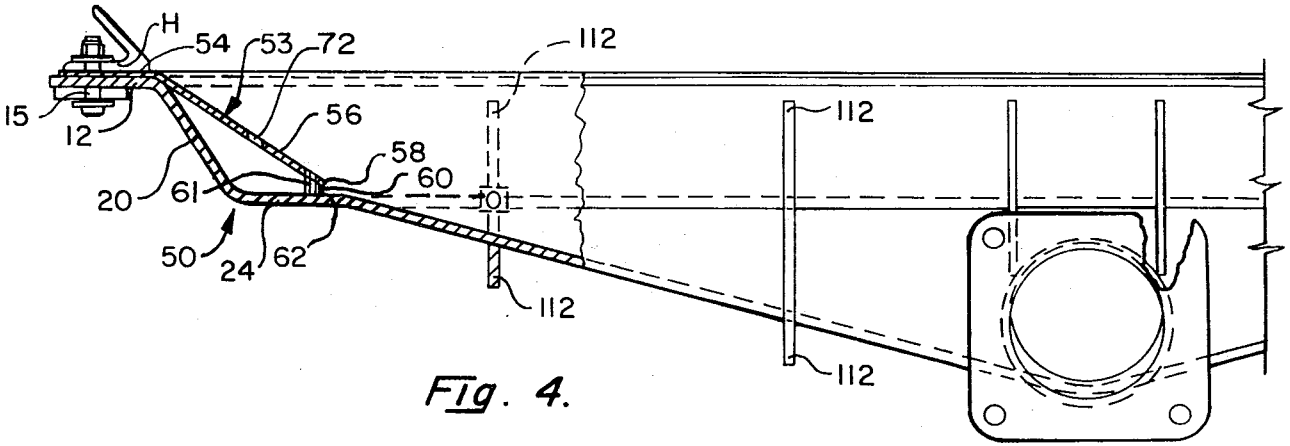
FIG. 4 is a sectional view taken in the direction of the arrows along the line 4—4 of FIG. 1 and illustrating the end plenum chamber of the present invention.
Figure 5:
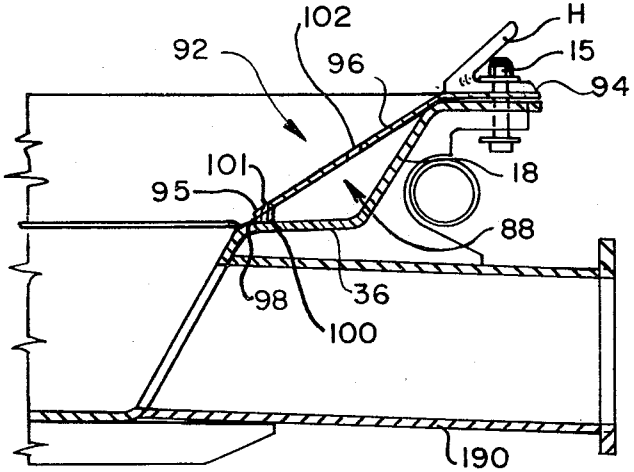
FIG. 5 is a sectional view taken in the direction of the arrows along the line 5—5 in FIG. 1 illustrating the longitudinal plenum chamber of the present invention.

One embodiment of the present invention is illustrated in FIGS. 1-6 of the drawings. The fluidizing outlet is indicated generally at 10. In this embodiment the outlet is generally rectangular and comprises a bottom pan 11 having a suitable generally horizontal upper mounting flange 12 with fastener openings 14 formed therein. Fasteners 15 hold the outlet in place on the hopper frame H (FIGS. 4 and 5). The bottom pan 11 includes transversely spaced inclined front and rear sides 16 and 18 (FIG. 3) and longitudinally spaced inclined ends 20 and 22 (FIG. 2). Ends 20 and 22 include respective upper inclined portions 23 and 25, horizontal portions 24 and 26 and respective lower portions 28 and 30 which are inclined toward a generally center discharge portion 32. Similarly, front and rear sides 16 and 18 include respective upper inclined portions 33 and 35, horizontal portions 34 and 36 (FIG. 3) and respective relatively steep inclined portions 38 and 40, which extend toward the center bottom discharge portion 32.

In accordance with the present invention, end plenum chambers 50 and 52 (FIG. 2) are provided in cooperation with bottom pan ends 20 and 22. As best shown in FIG. 4, end plenum 50 is formed by end plenum sheet 53 having a generally horizontal portion 54 which is held in place between the hopper frame H and the mounting flange 12 by means of mounting fasteners 15, and a portion 56 which extends downwardly to a point adjacent the juncture of the horizontal portion 24 and the lower inclined portion 28 of end 20. The plenum sheet 53 together with the upper inclined portion 23 and horizontal portion 24 of end 20 define the plenum chamber 50.

The lower edge 58 of plenum sheet 53 is spaced from the horizontal portion 24 of end 20 to provide a gap or opening 60 through which air under pressure may pass from the chamber 50 into the outlet to fluidize the lading. Spacers indicated at 62 (FIGS. 1 and 4) welded between horizontal portion 24 and sheet 53 at spaced points transversely across the outlet maintain the lower edge 58 spaced from horizontal portion 24. Plenum chamber 52 (FIG. 2) at the opposite end of the outlet is constructed in the same manner as plenum chamber 50 and includes a plenum sheet 64 having a lower edge 66 spaced from horizontal portion 26 to provide a gap or opening as indicated at 67, and spacers 68 (FIG. 1) provided transversely of the outlet to maintain the spacing between the lower edge 66 and the horizontal portion 26.

The gaps or openings 60 and 67 define first fluidizing openings which are of a size such that they are not readily clogged in operation, for example, by dirty supply air or improper outlet cleaning procedure, of a size to fluidize the lading, and of a size to obtain substantially complete cleanout of the lading during unloading. In accordance with the present invention it has been found that gaps or openings 60 and 67 should be within the range of about 0.030 to about 0.040 inches.

The length of the openings or gaps 60 and 67 extending transversely of the outlet is preferably at least about 30% of the transverse distance $D_1$ between the respective inner edges of the horizontal longitudinal mounting flanges. Thus for a railway hopper car having a 63 × 27 inch opening between the mounting flanges of the outlet, the transverse gap distance $D_2$ is preferably at least about 8 inches. Spacers 62 and 68, and any welds or fasteners affixing them to the pan preferably do not exceed about 25% of the transverse gap distance $D_2$.

A second series of transversely spaced fluidizing openings are provided though the plenum sheets 53 and 64 at a point above the lower edges 58 and 66 as indicated respectively at 72 and 74 in FIG. 1. These second fluidizing openings are of suitable size and regularity to fluidize the lading, are sufficiently large that they are not readily clogged in operation, for example, by dirty supply air or improper cleaning procedure, and of a size sufficient to obtain substantially complete cleanout of the lading during unloading. In accordance with the present invention it has been found that these second fluidizing openings should have a cross-sectional area within the range of about 0.002 to about 0.004 square inches and be provided at about 0.75 to 1.25 inches intervals. While the openings are shown in FIG. 1 as being circular, the openings need not be circular. They may be of any desired cross section so long as the resulting cross-sectional opening area is effective for fluidization and is not readily clogged.

Longitudinal plenum chambers 86 and 88 (FIG. 3), similar to plenum chambers 50 and 52, are provided in connection with the front and rear sides 16 and 18 of the bottom pan 11. Plenum chamber 88 which is illustrated in FIG. 5 is formed by a plenum sheet 92 having a horizontal portion 94 which is held in place between the hopper frame H and the mounting flange 12 by fasteners 15, and includes an inclined portion 96 which extends downwardly to a point adjacent the juncture of the horizontal portion 36 and portion 40 of the side 18 of the bottom pan 11. The lower edge 97 of the portion 96 of plenum sheet 92 is spaced from the horizontal portion 36 of side 18 to provide a gap or opening 98 of size sufficient for air under pressure to pass from the plenum chamber 88 into the outlet to fluidize the lading, of a size not readily clogged by dirty supply air or improper outlet cleaning procedure, and of a size sufficient to obtain substantially complete cleanout of the lading during unloading. In accordance with the present invention it has been found that gaps or openings 60 and 67 should be within the range of about 0.030 to 0.040 inches. Spacers 100 (FIG. 1) welded between the plenum sheet 92 and horizontal portion 36 at spaced points longitudinally of the outlet maintain the spacing between the lower edge 97 of the plenum sheet 92 and the horizontal portion 36.

A plurality of spaced openings 102 are also provided through the plenum sheet 92 above the lower edge 97 to further define the second fluidizing openings. The openings 102 are of a size and frequency to effect fluidization of the lading, are not readily clogged in operation, and of a size to obtain substantially complete cleanout of the lading during unloading. In accordance with the present invention it has been found that these said fluidizing openings should have a cross-sectional area within the range of about 0.002 to 0.004 square inches and be provided at about 0.75 to 1.25 inch intervals.

Plenum chamber 86 (FIG. 3) on the other side of the outlet is constructed in the same manner as plenum chamber 88 and includes a plenum sheet 104. The lower edge 105 of the plenum sheet 104 is spaced from the horizontal portion 34 of the side 16 to provide a fluidizing gap or opening 106 and spacers 107 maintain the spacing between the lower edge 105 and the horizontal portion 34. Additional openings 108, similar to the openings 102 of plenum sheet 88, are provided through the sheet 104 above the lower edge 105.

The length of the longitudinal gaps 98 and 105 ($D_3$ in FIG. 1) is preferably at least 50% of the longitudinal length $D_4$ between the inner edges of the transverse mounting flanges. Thus for the above mentioned 63 × 27 inch outlet, the gaps 98 and 105 are preferably at least about 31.5 inches. As mentioned above, the spacers and any fastening means to maintain the spacers integral with the pan preferably do not exceed about 20% of the longitudinal gap distance $D_3$.

Spacers 62, 68, 100 and 107 integral with pan 12 have been illustrated to maintain the gaps or openings between the respective end and side plenum sheets and the bottom pan. However, such spacing may be provided by other means. For example, openings may be provided in the lower edges of the plenum sheets, temporary spacers inserted between the plenum sheets and the pan, and sufficient weld metal applied through the openings to provide weld metal spacers which maintain the gap, and prevent the sheets from moving upwardly under fluidizing air pressure. Alternatively, mechanical fasteners may be used as spacers to provide the gaps. It is also within the scope of the present invention to eliminate the spacers altogether, and utilize relatively rigid plenum sheets, cantilevered from the mounting frame. When spacers are not used, the plenum sheets are preferably sufficiently rigid that when fluidizing air pressure is applied to the plenum chambers, the respective gaps at the lower edges of the side and end plenum sheets do not vary sufficiently that fluidization of the lading is not achieved.

Reinforcing ribs 112 may be provided, if desired, spaced longitudinally of the outlet 10 which extend transversely of the pan 11 to support the pan 11, particularly during unloading. Furthermore, if desired, in addition to spacers 62, 68, 100 and 107, supports 116 and 118 (FIG. 1) may be provided affixed to the pan and to the respective plenum sheets to support the respective end, and side plenum sheets in plenum chambers 50, 52, and 86 and 88.

The ends of plenum chamber 50 are connected to the adjacent ends of plenum chambers 86 and 88 and the ends of plenum chamber 52 are connected to the adjacent ends of plenum chambers at the opposite end of outlet 10 whereby the chambers 50, 52, 86 and 88 together form a continuous plenum chamber around the full circumference of the outlet 10 at the upper portion thereof.

Figure 6:
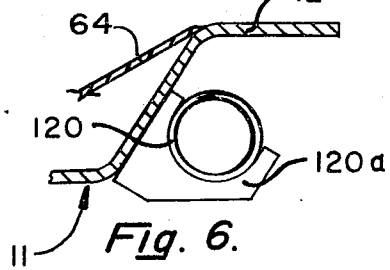
FIG. 6 is a partial sectional view taken in the direction of the arrows along the line 6—6 in FIG. 1.

Air under pressure is adapted to be introduced into the continuous plenum chamber so formed by a pipe 120 which, as best shown in FIGS. 1, 2 and 3, is connected at 121 to the left end portion of plenum chamber 88, as viewed in FIGS. 1 and 2, and is connected at the opposite end at 122 to the right end portion of plenum chamber 86 on the opposite side of the outlet. As shown in FIg. 6, the pipe 120 is supported from the sides of the bottom pan 11 by suitable brackets 120*a*. Pipe 120 is adapted to be connected to a suitable supply of air under pressure through a tee fitting 123 provided intermediate of the ends of the pipe 121. As the plenum chambers 50, 52, 86 and 88 are interconnected, air under pressure from the pipe 121 flows into each of the plenum chambers 50, 52, 86 and 88. From the chambers 50, 52, 86 and 88 the air under pressure passes through the gap 60 and openings 72 of plenum chamber 50, the gap 67 and openings 74 of plenum chamber 52. The gap 106 and openings 108 of plenum chamber 86 and the gap 98 and openings 102 of the chamber 88 to thereby fluidize lading in the outlet 10. The fluidized lading may discharge through a discharge pipe 124 (FIGS. 1, 2 and 3) which extends through and is secured to side 18 and communicates with the discharge portion 32 of the bottom pan 11 of the outlet 10.

Suitable piping and valve arrangement indicated generally at 125, may be provided to connect the outlet to a source of air under pressure. The particular piping and valve arrangement is of the general type disclosed in U.S. Pat. No. 3,708,209 and reference is made to said patent for a more detailed description of the structure and operation thereof.

Briefly, the piping and valving arrangement 125 includes an inlet pipe 126, having a removable cap 127; a check valve 128, a tee fitting 129, having one leg 129*a* connected to the tee fitting 123 of the pipe 120 and the other leg 129*b* connected to a control valve 130. Valve 130 is connected to a conduit 131 which communicates with and is formed as a part of an unloading conduit 132. Conduit 132 is connected by means of a lading control valve 133 to the end of discharge conduit 124 leading from the interior of the outlet. The outer end of unloading conduit 132 is provided with a removal cap 134.

In unloading a hopper to which the outlet 10 is attached, the cap 127 is first removed from the air inlet pipe 126 and a hose from a source of air under pressure is connected to the end of the pipe 126. The check valve 128 is opened by the air under pressure and air under pressure passes through the leg 129*a* of the tee fitting 129, through tee fitting 123 and the pipe 120 to the plenum chambers 50, 52, 86 and 88 and out of the openings in the plenum chambers 50, 52, 86, 88 to fluidize the lading and pressurize the interior of the hopper to which the outlet 10 is attached. Cover 134 on the end of discharge conduit 132 is then removed and valves 130 and 133 are opened. The fluidized lading in the outlet then moves downwardly and outwardly through the discharge pipe 124, the open lading control valve 133 and discharge conduit 132 under the influence of the stream of air from the interior of the outlet and hopper as supplied from the plenum chambers 50, 52, 86 and 88, and also by a stream of air which is directed through conduit 131 to discharge conduit 132 on the opening of valve 130. The valve 130 is adjusted so that the air from the inlet pipe 126 is divided between flow to the discharge conduit 131 and flow to the plenum chambers 50, 52, 86 and 88. Check valve 128 prevents a back flow of lading and air through the inlet pipe 126 and the air supply hose. As described in U.S. Pat. No. 3,708,209, a further check valve may be provided adjacent the control valve 130 as indicated by the reference numeral 135 to prevent the back flow of air and lading from the discharge conduit 132 through leg 129*a* of tee 129, tee 123 and pipe 120 into the plenum chambers 50, 52, 86, and 88.

The path of lading during unloading is generally indicated by arrows 176 in FIG. 1, inwardly and downwardly from end plenum sheets 53 and 64, and from side plenum sheets 92 and 104 down into center discharge portion 32. As previously described, discharge pipe 124 enters the lower portion of the outlet in discharge portion 32. As shown by the arrows 193, the lading above the discharge conduit 124 is directed down and around the mouth 124*a* of the discharge conduit 124 and an excessive amount of lading does not remain or build up in the outlet in the area above discharge conduit 124.

Figure 7:
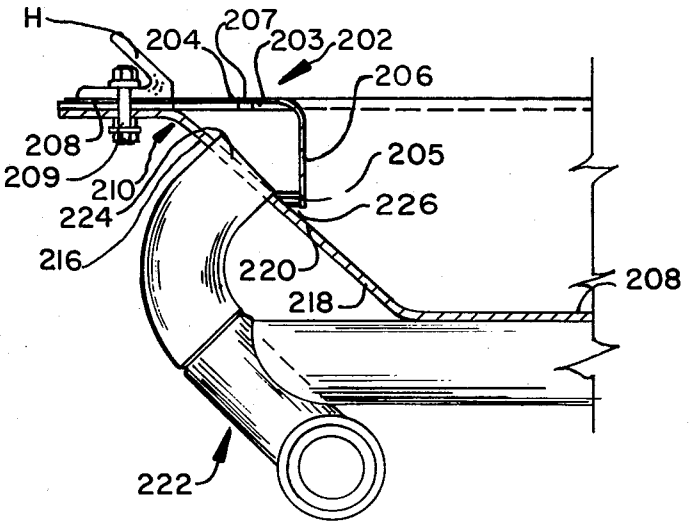
FIG. 7 is a transverse sectional view illustrating a further embodiment of the invention showing an alternative longitudinal plenum construction which may be used in accordance with the present invention.
Figure 8:
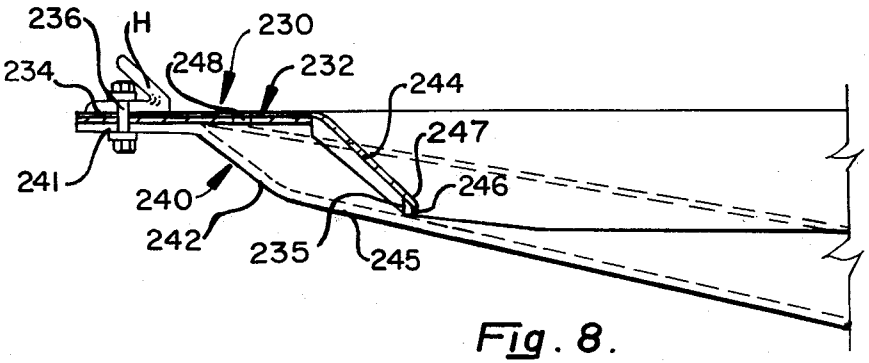
FIG. 8 is a longitudinal sectional view illustrating a further embodiment of the invention showing an alternative end plenum construction which may be used in accordance with the present invention.

Alternative embodiments of the present invention are illustrated in FIGS. 7 and 8. In the embodiment shown in FIG. 7, a longitudinal plenum chamber indicated at 202 is formed by a plenum sheet 203 having a horizontal portion 204 and a vertical portion 206. Suitable fasteners 209 maintain horizontal portion 204 between the hopper frame H and the mounting flange 208 of bottom pan 210. The pan side 216 is inclined at 218 and the hereinabove described spacing between the lower edge 205 and the pan side 218 is maintained to provide a gap 220 to define a first fluidizing opening. Second fluidizing openings 207 are provided in horizontal portion 204 having the hereinabove desired size and spacing. Piping indicated at 222 provides supply air to a plenum inlet 224.

In the embodiment illustrated in FIG. 8, an end plenum chamber 230 is formed by a plenum sheet 232 having a horizontal portion 234 held in place by fasteners 236 between the hopper frame H and mounting flange 241 of the pan end 240. The pan end is inclined downwardly as indicated at 242 but less steeply at 245. The plenum sheet 232 is inclined downwardly at 244 and the lower edge 246 is spaced from the portion 245 to provide a gap 247 forming a first fluidizing opening. Plenum sheet horizontal portion 234 has second fluidizing openings therein 248 for fluidizing lading discharge. Suitable piping (not shown) is provided to supply air to the plenum chamber 230, for example, as indicated at 222 in FIG. 7 having a single inlet 224 and/or along the lines of the embodiment illustrated in FIGS. 1–6, with dual inlets 74 and 121.

It is within the purview of the present invention to retrofit existing fluidizing outlets having membranes therein which tend to clog as heretofore described. These membranes may be removed and some or all of their support structure removed and the plenum sheets illustrated in FIGS. 1–6 and/or FIGS. 7 and 8 affixed in place so that the plenum chamber structure of the present invention can be utilized in existing fluidizing outlets.

The embodiments shown in FIGS. 7 and 8 further illustrate the principle that the specific shape of the plenum sheets or the particular contour of the pan is not critical to the present invention. So long as the spacing of the first fluidizing openings is maintained sufficient to fluidize the lading, sufficient to avoid clogging, and sufficient to obtain substantially complete cleanout of the lading, and the size and frequency of the second fluidizing openings maintained sufficient to fluidize the lading, avoid clogging and obtain substantially complete cleanout of the lading the outlet of the present invention will operate effectively.

The outlet need not be rectangular; it may be circular or of any desired shape in which the plenum chambers of the present invention can be fabricated.

The present invention provides a relatively simple, inexpensive outlet which is particularly useful in handling non-foodstuff ladings, such as cement, diatomaceous earth, aluminum oxide and bauxite.

It has been found by experiment that clogging of the outlet will become a problem if the fluidizing openings are smaller than about 0.002 square inches (which corresponds to a diameter of about 0.03 inches) for the second fluidizing openings, and a gap smaller than about 0.03 inches defining the first fluidizing openings.

It has been found by calculation that to have a sufficient volume of air to fluidize the lading from hoppers and containers normally unloaded pneumatically that the gap providing the first fluidizing openings must be at least about 0.03 inches and the size of the second fluidizing openings at least about 0.002 square inches, spaced at least about every inch.

The term "substantially complete cleanout or removal of the lading", as used herein, refers to an amount of lading remaining in the hopper or container and outlet after the unloading operation has been completed, of not more than about 1% by weight of the lading originating in the hopper or container.

It has been found that if gaps defining the first fluidizing openings exceed about 0.04 inches that after completion of the unloading operation, an undue amount of lading remains, in excess of about 1% by weight of the lading. Furthermore if the size of the second fluidizing openings exceeds about 0.004 square inches, an undue amount of lading tends to remain in the container, hopper or outlet.

It is thus apparent that by calculation and experimentation that a specific size range is required for the gap defining the first fluidizing openings, and the size and regularity of the second fluidizing openings.

It is preferred that the amount of lading remaining after completion of the unloading operation should not be in excess of about 0.5% by weight of the lading. With dual inlets located at opposite ends of a rectangular outlet as illustrated at 74 and 121 in FIGS. 1 and 3, not more than about 0.5% by weight of the lading will remain after the unloading operation.

The following examples illustrate the data obtained by applicants relative to the outlet of the present invention to establish the criticality of the foregoing ranges.

EXAMPLE ONE

A 5,700 cubic foot covered hopper car was utilized in this example. The center compartment containing approximately 1,300 cubic feet was loaded with approximately 7,000 lbs of diatomaceous earth. Each side of the compartment was vibrated for about 15 minutes with a Martin Engineering rotating vibrator to approximate a compacted load similar to that which occurs while a car is in transit. A fluidizing outlet constructed along the lines illustrated in FIGS. 7 and 8 was attached to this center compartment for unloading of the diatomaceous earth. Fluidizing air was applied to the outlet in the same manner as illustrated in FIGS. 1 and 2 of the drawings except through a single inlet such as illustrated at 224 in FIG. 7.

First fluidizing openings 226 and 246 in FIG. 7 and 8 had a gap of about 1/32 of an inch or about 0.0312 inches. Second fluidizing openings 207 and 248 were formed from ⅛ inch diameter holes (0.125 inch or 0.0123 square inches) on 2 inch centers. However inclined corner portions 250, 252, 254, and 256 in FIG. 1, having a length of about 2 inches, were left open with a gap between these inclined portions and the bottom pan of about ⅛ inch.

The unloading procedure was as follows: The hopper car was pressurized to 5 psi by closing the hatches and introducing air into the fluidizing outlet through conduit 222. When the car reached the pressure of 5 psi, bypass valve 130 (FIG. 1) was opened. Then control valve 133 was opened and unloading commenced through a conduit attached to discharge end 134. Unloading was continued in this manner until the pressure began to decrease, and until the pressure decreased to about 1 psi.

At this point to achieve final cleanout, control valve 133 was closed. Bypass valve 130 was closed. The car was again pressurized to 3 psi through conduit 220. Bypass valve 130 was then opened and product control valve 133 opened. Unloading was continued until the pressure again reached 1 psi. This final cleanout procedure was repeated twice more.

326 Pounds of diatomaceous earth was found remaining in the compartment after completion of the unloading procedure described above. This is considerably in excess of the 1% or less (70 pounds) which is considered to be a satisfactory amount of lading removal.

EXAMPLE TWO

The same test as carried out in Example One was repeated.

266 Pounds of lading was found remaining in the compartment.

EXAMPLE THREE

The outlet arrangement illustrated in FIGS. 7 and 8 of the drawings was modified to the extent that 1/16 inch diameter holes were used instead of ⅛ inch diameter holes and the 1/16 inch diamter holes were placed at approximately 1 inch intervals. Corner portions 250, 252, 254, and 256 remained open with a ⅛ inch gap for this approximately 2 inch distance.

The test was otherwise identical to the Examples One and Two.

220 Pounds of lading was found remaining in the compartment.

The use of 1/16 inch diameter holes 1 inch apart did reduce the amount of lading remaining in the outlet over that obtained in Examples One and Two, but not to an amount sufficiently low for commercial unloading of this type of lading.

EXAMPLE FOUR

The same outlet arrangement as utilized in Example Three was utilized except that the corner portions 250, 252, 254 and 256 were welded closed, closing the gap between the plenum sheet and the pan so that there no longer was an approximately ⅛ inch gap in these areas.

The procedure utilized was otherwise identical to that utilized in Example Three.

140 pounds of lading remained in the compartment. While this is in excess of the 1% weight objective, if this amount could be obtained with a full hopper (about 25,000 lbs.) this would be considered to be a satisfactory amount of lading remaining in the outlet.

EXAMPLE FIVE

Example Four was repeated a number of times with prototype outlets constructed according to that described in Example Four, except the compartment was filled each time with about 25,000 pounds of diatomaceous earth. In addition to the center compartment utilized in Examples One through Four, end compartments of the hopper car were also utilized.

Values of between 100 and 200 pounds of lading remaining were obtained in each case.

The result of not more than about 200 pounds remaining with an initial lading hopper load of about 25,000 lbs. indicates that less than 1% of the lading remained in the compartment in these tests.

EXAMPLE SIX

Outlets for production use were constructed according to the construction shown in FIGS. 1 to 6 of the drawings, except that a single inlet similar to inlet 224 in FIG. 7 was used. Subsequently it was found that the gap defining the first fluidizing openings was found to be between 0.04 and 0.075 inches.

The loading and unloading procedure were the same as utilized in Example Five.

1908 Pounds of lading was found remaining in the compartment. This was an unsatisfactory amount.

EXAMPLE SEVEN

Example Six was repeated and 2001 pounds were found in the compartment; thus verifying the unsatisfactory result achieved in Example Six.

EXAMPLE EIGHT

Examples Six and Seven were repeated with the modification that the gap in the first fluidizing openings was maintained within the range of 0.03 to 0.04 inches. Furthermore instead of the single air inlet illustrated in FIG. 7, a dual air inlet as illustrated in FIGS. 1 and 2 were utilized.

47 Pounds of lading remained.

EXAMPLE NINE

Example Eight was repeated and only 12 pounds of lading remained.

It will be apparent that in Examples Eight and Nine with the dual air inlet, that not more than 0.5% of the lading remained, a very desirable result from the commercial standpoint.

Comparison of Examples Eight and Nine with Examples Six and Seven reveals that if there is a significant amount of the first fluidizing openings having a gap in excess of about 0.004 inches that this tends to result in an undue amount of lading remaining in the outlet.

It will also be noted that comparing Examples Six and Seven with Example Three yields a consistent result. With the corners 250, 252, 254, and 256 open in Example Three having a ⅛ inch gap (0.125 inches for 2 inches) 220 pounds of lading was found remaining. However when this gap was closed in Example Four only 140 pounds of lading remained.

Comparison of Example Three with Examples One and Two reveals the importance of utilizing openings of about 1/16 inch (0.002 to 0.004 inch) placed at 1 inch centers instead of the ⅛ inch diameter holes at 2 inch centers. The amount of lading remaining was significantly reduced. Also as mentioned in the specification it has been found that if openings less than about 1/32 inch in diameter (0.002 in.$^2$) are utilized that clogging of the openings becomes a problem.

It therefore is believed that the data obtained in the above Examples demonstrate that if the first fluidizing openings are maintained within a range of about 0.03 to about 0.04 inches and the second fluidizing openings have a cross-sectional area within the range of about 0.002 to about 0.004 square inches, about 0.75 to about 1.25 inches apart, that the amount of lading remaining in the outlet can be maintained at satisfactory levels for commercial unloading.

What is claimed:

1. A fluidizing outlet comprising:

a bottom pan inclined downwardly from an upper mounting flange for mounting on a hopper; at least one plenum sheet extending from said mounting flange downwardly; said plenum sheet and said bottom pan defining therebetween a plenum chamber; at least a portion of said plenum sheet at the lower edge thereof being spaced from the bottom pan within the range of about 0.03 to about 0.04 inches to define first fluidizing openings; said first fluidizing openings being sufficient to effect fluidization of particulate lading, being sufficient that the openings are not readily clogged during operation, and being sufficient to obtain substantially complete removal of the lading during unloading;

said plenum sheet having a plurality of second fluidizing openings spaced from said lower edge of said plenum sheet in communication with said plenum chamber and extending through said plenum sheet and being spaced from each other within the range of about 0.75 to about 1.25 inches and of a size within the range of from about 0.002 to about 0.004 in.$^2$ and sufficient to effect fluidization of particulate lading, sufficient that the openings are not readily clogged during operation, and sufficient to obtain substantially complete removal of the lading during unloading; and means for supplying fluidizing air to said plenum chamber whereby said fluidizing air may pass through said first and second fluidizing openings to fluidize the lading.

2. A fluidizing outlet according to claim 1 including means for maintaining said plenum sheet spaced from the bottom pan of the outlet at said distance.

3. A fluidizing outlet according to claim 2 wherein the means for maintaining said plenum sheet spaced from the bottom pan comprises spacers integral with said pan.

4. A fluidizing outlet according to claim 3 wherein said spacers comprise weld metal.

5. A fluidizing outlet according to claim 2 wherein the means for maintaining said plenum sheet spaced from the bottom pan comprises fasteners mounting said plenum sheet on said mounting flange.

6. A fluidizing outlet comprising:

a bottom pan inclined downwardly from an upper mounting flange for mounting on a hopper; said bottom pan comprising transversely spaced at least partly inclined pan sides, and longitudinally spaced at least partly inclined pan ends; a pair of side plenum sheets extending from the mounting flange of the outlet downwardly above said pan sides; a pair of end plenum sheets extending from the mouting flange downwardly above said pan ends; said side plenum sheets and said pan sides defining therebetween respective side plenum chambers; said end plenum sheets and said pan ends defining therebetween respective end plenum chambers; at least a potion of said side plenum sheets and at least a portion of said end plenum sheets at the lower edges thereof being spaced from the respective pan sides and pan ends to define first fluidizing openings; said first fluidizing openings being of a size within the range of from about 0.03 to about 0.04 inches and sufficient to fluidize a particulate lading, sufficient that the openings are not readily clogged during operation, and sufficient to obtain substantially complete cleanout of the lading during unloading; means for maintaining said side plenum sheets and said end plenum sheets spaced respectively from said pan sides and pan ends; said side plenum sheets and said end plenum sheets having a plurality of second fluidizing openings spaced from the respective lower edges thereof of a size within the range of from about 0.002 to about 0.004 in.$^2$ spaced apart from about 0.75 to about 1.25 inches and sufficient to fluidize a particulate lading, sufficient that the openings are not readily clogged during operation, and sufficient to obtain substantially complete cleanout of the lading during unloading; and means for supplying fluidizing air to said side plenum chambers and end plenum chambers whereby said fluidizing air may pass through said first and second fluidizing openings to fluidize lading.

7. A fluidizing outlet according to claim 6 wherein the upper mounting flange includes longitudinal mounting flanges and wherein the length of the first fluidizing openings in said end plenum chambers is at least 30% of the distance between the respective inner edges of the longitudinal mounting flanges.

8. A fluidizing outlet according to claim 7 wherein the upper mounting flange includes transverse mounting flanges and wherein the length of the first fluidizing openings in said longitudinal plenum chambers is at least 50% of the distance between the inner edges of the transverse mounting flanges.

9. A fluidizing outlet according to claim 8 wherein said side plenum sheets are inclined.

10. A fluidizing outlet according to claim 9 wherein said end plenum sheets are inclined.

11. A fluidizing outlet according to claim 8 wherein said side plenum sheets have generally horizontal and vertical portions and an angle of about 90° therebetween.

12. A fluidizing outlet according to claim 8 wherein the means for supplying air chambers includes at least two air inlets into the outlet.

13. A fluidizing outlet according to claim 12 wherein the inlets are located at opposite ends of the outlet.

14. A fluidizing outlet according to claim 6 wherein the means for maintaining said plenum sheets spaced from the bottom pan comprises spacers integral with said pan.

15. A fluidizing outlet according to claim 14 wherein said spacers comprise weld metal.

16. A fluidizing outlet according to claim 6 wherein the means for maintaining said plenum sheets spaced from the bottom pan comprises fasteners mounting said plenum sheet on said mounting flange.

* * * * *

UNITED STATES PATENT AND TRADEMARK OFFICE

CERTIFICATE OF CORRECTION

PATENT NO. : 4,036,532

DATED : July 19, 1977

INVENTOR(S) : Jerry D. Waddell and John J. Scheeter

It is certified that error appears in the above-identified patent and that said Letters Patent are hereby corrected as shown below:

Claim 12, line 2, after "air" insert -- to said --.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*